US008011422B2

(12) United States Patent
Yamazaki et al.

(10) Patent No.: US 8,011,422 B2
(45) Date of Patent: Sep. 6, 2011

(54) EGR COOLER

(75) Inventors: Toru Yamazaki, Nagoya (JP); Yoichi Nakamura, Nagoya (JP); Noriyuki Ishii, Nagoya (JP); Toshikatsu Hachiya, Nagoya (JP)

(73) Assignee: T.RAD Co., Ltd., Tokyo (JP)

( * ) Notice: Subject to any disclaimer, the term of this patent is extended or adjusted under 35 U.S.C. 154(b) by 824 days.

(21) Appl. No.: 11/901,836

(22) Filed: Sep. 19, 2007

(65) Prior Publication Data

US 2008/0314569 A1 Dec. 25, 2008

(30) Foreign Application Priority Data

Jun. 21, 2007 (JP) ..... 2007-164162

(51) Int. Cl.
*F28D 7/06* (2006.01)
*F28F 27/02* (2006.01)
*F02B 47/08* (2006.01)

(52) U.S. Cl. ..... 165/82; 165/69; 165/103; 165/157; 165/176; 123/568.12

(58) Field of Classification Search ..... 165/103, 165/157, 176, 69, 82; 123/568.12
See application file for complete search history.

(56) References Cited

U.S. PATENT DOCUMENTS

| | | | | |
|---|---|---|---|---|
| 4,328,859 | A * | 5/1982 | Bouvot | 165/78 |
| 4,685,430 | A * | 8/1987 | Ap | 123/142.5 R |
| 4,735,260 | A * | 4/1988 | Wohrl et al. | 165/69 |
| 5,178,102 | A * | 1/1993 | Kehrer et al. | 165/103 |
| 5,318,114 | A * | 6/1994 | Sasaki | 165/176 |
| 5,632,328 | A * | 5/1997 | Sawyer et al. | 165/69 |
| 6,302,196 | B1 * | 10/2001 | Haussmann | 165/176 |
| 7,438,062 | B2 * | 10/2008 | Okawa et al. | 165/103 |
| 2004/0003916 | A1 * | 1/2004 | Nash et al. | 165/153 |
| 2006/0288694 | A1 | 12/2006 | Hayashi | |
| 2007/0289727 | A1 * | 12/2007 | Auchter et al. | 165/176 |

FOREIGN PATENT DOCUMENTS

JP 2007-9724 1/2007

* cited by examiner

*Primary Examiner* — Leonard Leo
(74) *Attorney, Agent, or Firm* — Jordan and Hamburg LLP

(57) ABSTRACT

To provide an EGR cooler which has a small number of parts and achieves compact design with low cost. A plurality of flat tubes, each having a bottom to close an end thereof, is arranged in parallel. An opening of each of the flat tubes penetrates through a tube plate. Corrugated fins are placed in each of the flat tubes, thus forming a core. A casing encloses the outer circumferential surface of the core. The tube plate closes the opening of a tank body equipped with a partition. The edge of the partition is placed at an intermediate position in the width direction of the opening of the flat tube.

7 Claims, 4 Drawing Sheets

EGR COOLER

BACKGROUND OF THE INVENTION

1. Field of the Invention

The present invention relates to an EGR cooler.

2. Related Background of the Invention

An EGR cooler is proposed by the Patent Document 1 given below. According to the proposed EGR cooler, a plurality of flat tubes is arranged in parallel, and both ends thereof penetrate through the respective header plates, thus structuring a core. A casing encloses the outer circumferential surface of the core to form a cooler body. A bypass pipe is laid along the cooler body. The bypass pipe and one end of the cooler body are connected via a tank, while the other end of the cooler body and the bypass pipe are connected to a tank having a gate valve.

[Patent Document 1] Japanese Patent Laid-Open No. 2007-9724

SUMMARY OF THE INVENTION

Conventional EGR coolers are fabricated by a large number of parts, and have a complicated structure, resulting in expensive ones. In addition, they have a drawback of non-compactness. To solve the problems, the present invention aims to provide a compact EGR cooler integrated with a bypass valve with a small number of parts.

A first aspect of the present invention provides an EGR cooler having the structure of: a plurality of flat tubes (1), each having a bottom portion (1*a*) closing one end thereof, having an opening (1*b*) at the other end thereof, being arranged in parallel facing flat face thereeach; corrugated fins (2) formed in each of the flat tubes (1) while keeping a space (1*c*) against the bottom portion (1*a*) so as a ridgeline (2*a*) of each of the corrugated fins (2) to extend from the opening (1*b*) to the bottom portion (1*a*); a header plate (3) to which the opening (1*b*) of each of the flat tubes (1) penetrates therethrough and is fixed thereto, and a core (4) formed by the flat tubes, corrugated fins and header plate, wherein: the outer circumferential surface of the core (4) is enclosed by a casing (5); the header plate (3) closes an open end of a tank body (7) equipped with a partition (6); and the partition (6) is located at an intermediate position in the width direction of the opening (1*b*) of each of the flat tubes (1), and wherein a flue gas (9) is introduced to one side of the partition (6) in each of the flat tubes (1), and then takes a U-turn at the bottom portion (1*a*) to flow out from other side of the partition (6), while a cooling water (10) is introduced into the casing (5).

A second aspect of the present invention provides the EGR cooler according to the first aspect of the invention, further having an elastic support (11) which supports outer circumferential surface of the bottom portion (1*a*) of each of the flat tubes (1) at one end portion thereof, while the other end portion thereof is attached to the casing (5).

A third aspect of the present invention provides the EGR cooler according to the second aspect of the invention, wherein the casing (5) has a concave portion (21) at an intermediate position of the bottom portion thereof, and the other end portion of the elastic support (11) is fitted into the concave portion (21).

A fourth aspect of the present invention provides the EGR cooler according to any of the first to third aspects of the invention, wherein the partition (6) has a connection opening (6*a*) which is closed by a bypass valve (8) capable of being arbitrarily closed or opened.

A fifth aspect of the present invention provides the EGR cooler according to any of the first to fourth aspects of the invention, wherein each of the flat tubes (1) penetrating through the header plate (3) has a notched portion (25), at an intermediate position of an edge thereof in the width direction, cut to the face of the header plate (3), and an edge of the partition (6) contacts with the notched portion (25).

A sixth aspect of the present invention provides the EGR cooler according to any of the first to fourth aspects of the invention, wherein the header plate (3) has a protruded strip (3*a*) at a position facing an edge of the partition (6) so as the protruded strip (3*a*) and an edge of each of the flat tubes (1) to become flush with each other, and the edge of the partition (6) contacts with the protruded strip (3*a*).

A seventh aspect of the present invention provides the EGR cooler according to any of the first to fifth aspects of the invention, wherein the outer circumferential surface of the bottom portion (1*a*) of each flat tube (1) is formed in an arc shape, auxiliary fins (2*b*) are arranged at the bottom portion (1*a*), and the bottom portion (1*a*) and the auxiliary fins (2*b*) are brazed to fix them together.

An eighth aspect of the present invention provides the EGR cooler according to any of the first to sixth aspects of the invention, wherein each flat tube (1) is a brazed article structured by a pair of plates (29) and (30), having the respective side walls (29*a*) and (30*a*), erecting at the periphery thereof except at the opening of flat tube (1), while the side walls (29*a*) and (30*a*) have the respective concave portions (29*b*) and (30*b*) at the respective matching positions thereeach, thus fitting the concave portions (29*b*) and (30*b*) thereeach.

According to the EGR cooler of the present invention, corrugated fins 2 are located in the flat tube 1 having the bottom portion 1*a*, and the opening 1*b* of each of the plurality of flat tubes 1 penetrates to fix to the header plate 3, thereby forming the core 4. The outer circumferential surface of the core 4 is enclosed by the casing 5. The header plate 3 closes the opening at an end of the tank body 7 provided with the partition 6. Since the partition 6 is located at an intermediate position in the width direction of the opening 1*b* of the flat tube 1, the number of parts is small and the structure is quite simple, thus providing a U-turn flow compact EGR cooler at a low cost.

With the above structure, the one which locates the elastic support 11 between the bottom portion 1*a* of each flat tube 1 and the casing 5 smoothly absorbs the thermal expansion of the EGR cooler in operating state, and the elastic support 11 always supports each flat tube 1, thus providing a high strength EGR cooler enduring vibrations and other mechanical disturbances.

With the above structure, the one which forms the concave portion 21 at an intermediate position at the bottom portion of the casing 5 and which fits other edge portion of the elastic support 11 to the concave portion 21 provides a highly reliable EGR cooler with readily installation.

With the above structure, the one which has the connection opening (6*a*) on the partition (6) and which closes the connection opening (6*a*) with the arbitrarily closing and opening bypass valve (8) allows the flue gas to bypass the flat tube (1) by opening the bypass valve (8), at a low flue gas temperature, thus preventing supercooling of the flue gas.

With the above structure, the one which has the notched portion 25, at an intermediate position in the width direction of an edge of the flat tube 1 penetrating through the header plate 3, thus making an edge of the partition 6 contact with the notched portion 25, provides a compact EGR cooler with simple structure free of leakage.

With the above structure, the one which has the protruded strip 3*a* on the header plate 3 to make an edge of the partition 6 contact with the protruded strip 3*a* provides a highly reliable EGR cooler with simple structure and improved air-tightness of the partition 6.

With the above structure, it is possible that the face outer circumference of the bottom portion (1*a*) of the flat tube (1) is formed in an arc shape, that the auxiliary fins (2*b*) are arranged on the bottom portion (1*a*), and that the bottom portion (1*a*) and the auxiliary fins (2*b*) are brazed to fix them together. In that case, the pressure strength of the bottom portion (1*a*) of the flat tube (1) can be increased.

With the above structure, it is possible that the flat tube (1) is formed by a brazed article structured by combining a pair of plates (29) and (30) having the respective side walls (29*a*) and (30*a*) erecting at the periphery thereeach except at the opening of flat tube (1), and that the concave portions (29*b*) and (30*b*) are formed on the respective side walls (29*a*) and (30*a*) at the matching position thereeach, thus fitting the concave portions (29*b*) and (30*b*) thereeach. In that case, on assembling and brazing the core, the pair of plates (29) and (30) is prevented from misalignment in the flat direction thereof, thus providing a highly reliable EGR cooler.

DETAILED DESCRIPTION OF THE INVENTION

Figure 1:
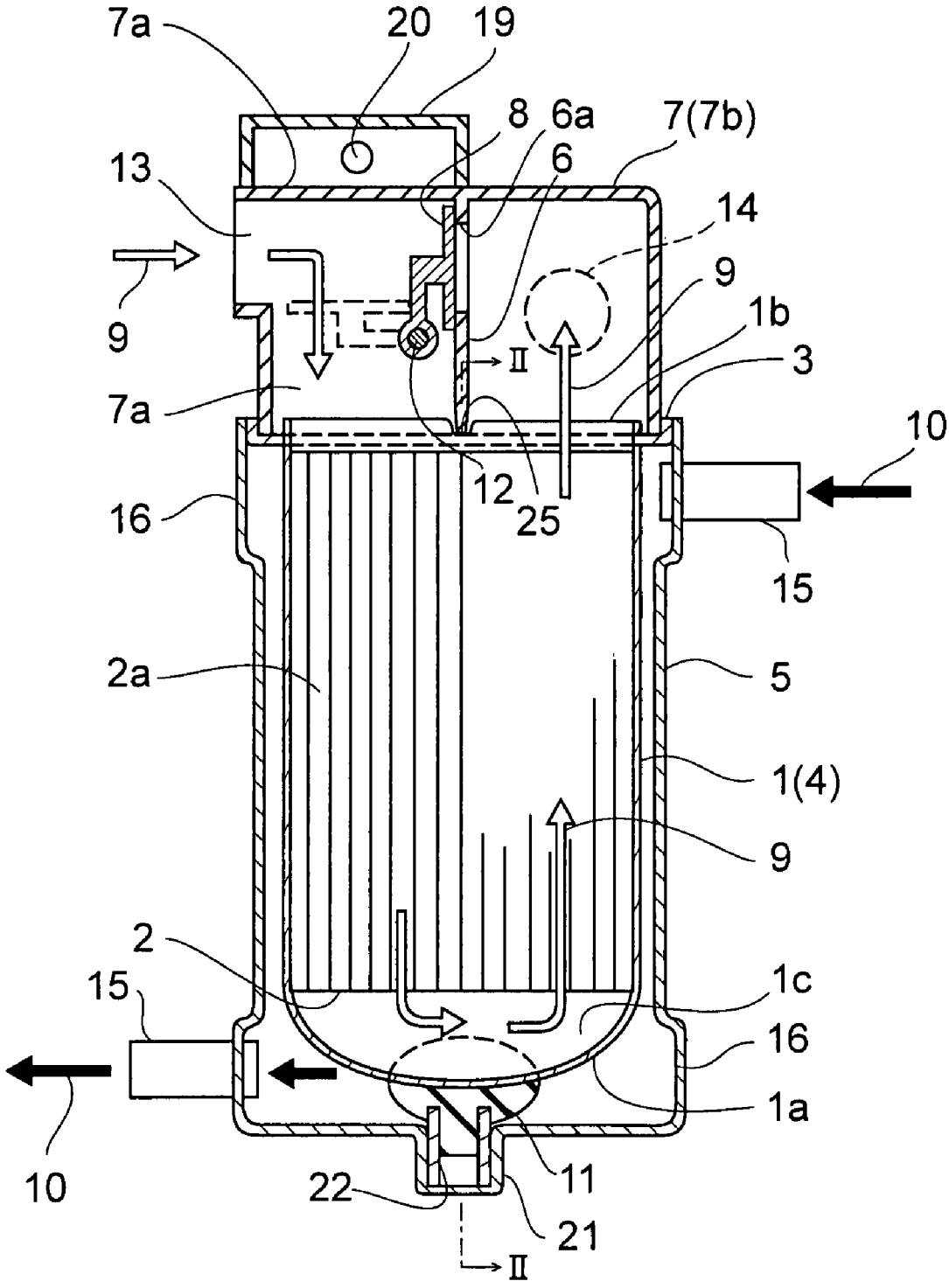
FIG. 1 shows a vertical cross section of an EGR cooler according to the present invention.

Embodiments of the present invention will be described below referring to the drawings.

Figure 2:
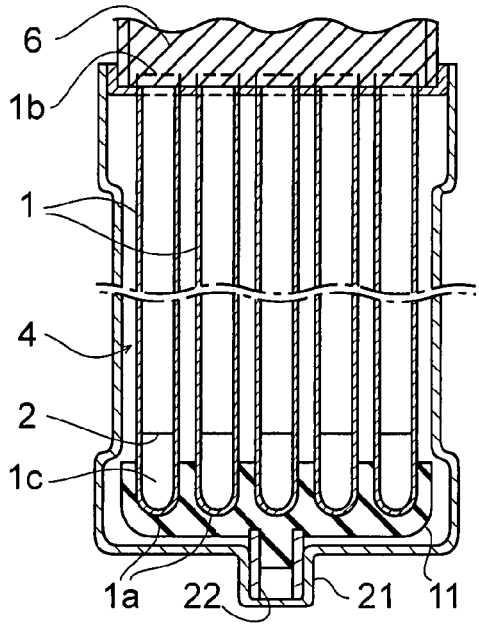
FIG. 2 shows the cross sectional view along II-II line in FIG. 1.
Figure 3:
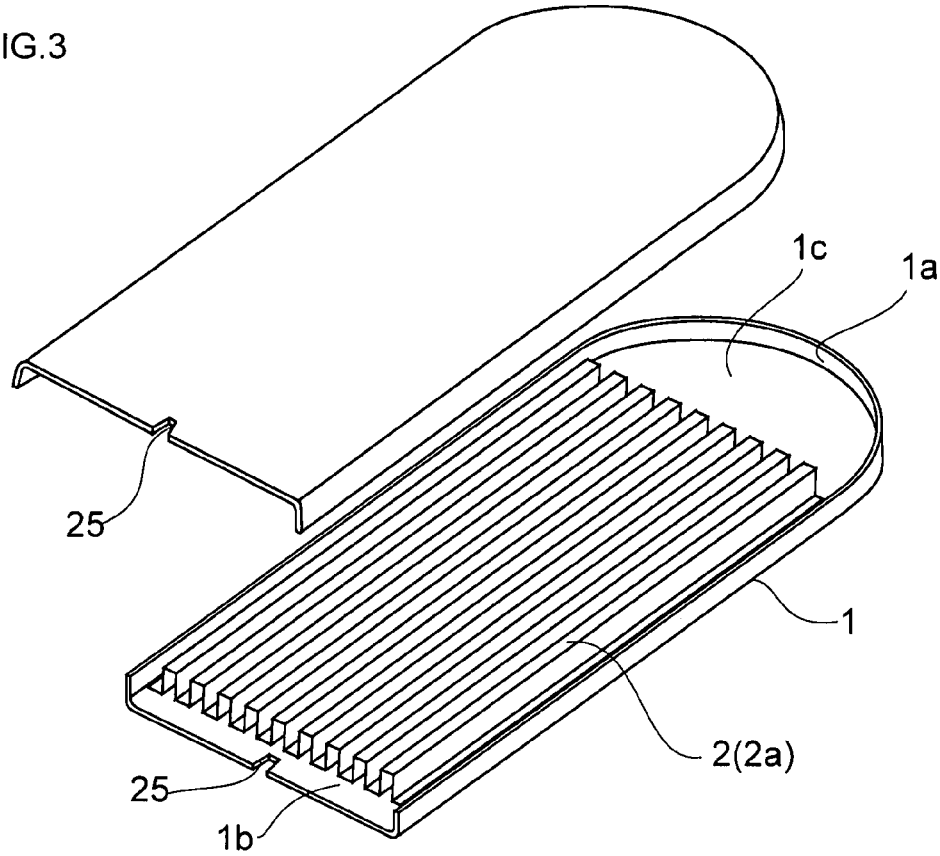
FIG. 3 shows an exploded perspective view of a flat tube 1 applied in the EGR cooler.
Figure 4:
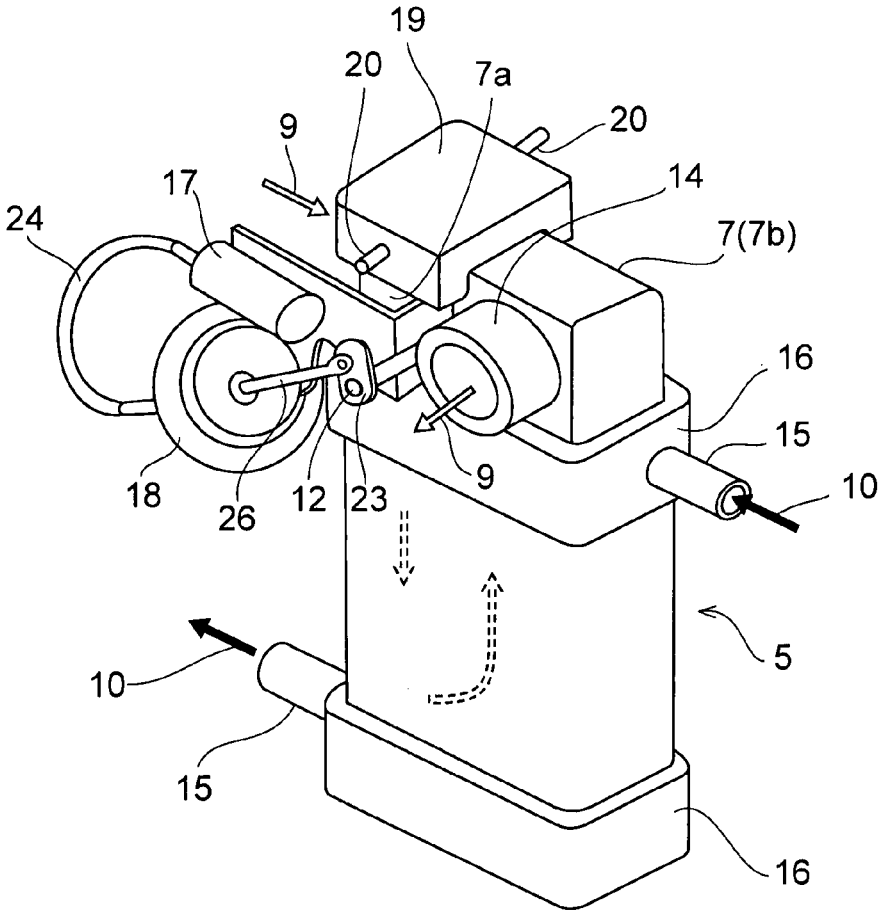
FIG. 4 shows a perspective appearance of the EGR cooler.

FIG. 1 shows a vertical cross section of an EGR cooler according to the present invention, FIG. 2 shows the cross sectional view along II-II line in FIG. 1, FIG. 3 shows an exploded perspective view of the flat tube 1 having the corrugated fins 2, and FIG. 4 shows a perspective appearance of the EGR cooler.

As illustrated in FIGS. 1 and 2, the EGR cooler has a plurality of flat tubes 1 arranged in parallel facing the flat face thereof each other, and the opening 1*b* of each flat tube 1 penetrates through and fixes to the header plate 3, thus forming the core 4. The casing 5 encloses the outer circumferential surface of the core 4, and the header plate 3 closes the opening at an end of the tank body 7 equipped with the partition 6.

As illustrated in FIG. 3, each flat tube 1 is formed by a pair of plates. The peripheral portion of each plate erects except an end in the longitudinal direction thereof. Both plates are fitted with each other, and the fitted portion is brazed or welded to fix them together. On outer face of the flat tube, there are a large number of dimples for spacer (not shown). Each flat tube 1 has the bottom portion 1*a* in flat arc shape, and has the corrugated fins 2 inside thereof except in the bottom portion 1*a*. The ridgeline 2*a* on each of the corrugated fins 2 extends from the opening 1*b* to the bottom portion 1*a*.

The corrugated fins 2 have a flat face at rise portion and at down portion of each fin, and there exists no louver such as cut-louver. With the configuration, the flue gas flowing through the inside space of the fin is prevented from moving in the width direction of the flat tube 1.

According to the example, the notched portion 25 is formed at an intermediate position in the width direction at an edge of the opening 1*b* of each flat tube 1, (although the position in this example is at the center of the width direction, the present invention does not limit the position to the center in the width direction).

The flat tube 1 configured as above is inserted into a tube penetration hole (not shown) in the header plate 3, and the inserted flat tube 1 and the header plate 3 are fixed by brazing or other means at the penetration portion, thus forming the core 4. The bottom of the notched portion 25 of each flat tube 1 is positioned to become flush with the face of the header plate 3. The casing 5 is enclosed to the outer circumferential surface of the core 4.

The casing 5 has an annular expanded portion 16 which slightly expands outward at each end in the longitudinal direction thereof. To each of both annular expanded portions 16, an inlet/outlet pipe 15 penetrates to fix them together. At the bottom portion of the annular expanded portion 16 of the casing 5, a concave portion 21 is formed. One end of the elastic support 11 is fitted to fix to the concave portion 21 via a bracket 22. As illustrated in FIG. 2, the other end of the elastic support 11 enters into each space between the bottom portions 1*a* of the flat tubes 1, thus supporting the outer circumferential surface of the bottom portion 1*a* of each flat tube 1.

The header plate 3 closes an end opening of the tank body 7. The tank body 7 has the partition 6 at an intermediate position thereof to divide the inside space thereof into an inlet tank portion 7*a* and an outlet tank portion 7*b*. That is, the edge of the partition 6 contacts to fix with the header plate 3 at the position of the notched portion 25 of each flat tube 1. The partition 6 has the connection opening 6*a*, and the connection opening 6*a* is closed by the bypass valve 8 capable of being arbitrarily closed or opened. In concrete terms, the bypass valve 8 moves from the position of the solid line to the position of broken line. A rotary shaft 12 of the bypass valve 8 protrudes outward from the tank body 7, as shown in FIG. 4, and the front end of the rotary shaft 12 is fixed to one end of a first link 23. At the other end of the first link 23, one end of a second link 26 is fixed, while the other end of the second link 26 penetrates through an actuator 18. The actuator 18 drives a second link 26 in a state of arbitrarily extending and retracting using a controller 17, thus rotating the rotary shaft 12 via the first link 23 to move the bypass valve 8 from the position of solid line to the position of broken line in FIG. 1, as described above. The bypass valve 8 can be held at an intermediate position between the solid line one and the broken line one.

The controller 17 according to the example generates a negative pressure when the flue gas temperature is relatively low, and the generated negative pressure enters the actuator 18 via a connection pipe 24, thus driving the second link 26 to open the bypass valve 8.

As described before in FIG. 1, the tank body 7 is divided by the partition 6 into the inlet tank portion 7*a* and the outlet tank portion 7*b*, while an auxiliary tank 19 is fitted to outer circumferential surface of the inlet tank portion 7*a*. Through a cooling water pipe 20, the cooling water is supplied to the auxiliary tank 19, thus cooling the outer circumferential surface of the inlet tank portion 7*a*.

The cooling water 10 enters the casing 5 through one inlet/outlet pipe 15 to cool the outer circumferential surface of each flat tube 1, then flows out from other inlet/outlet pipe 15.

The high temperature flue gas 9 flows through one side in the width direction of each flat tube 1, entering from an inlet 13 of the inlet tank portion 7*a*. Then, the flue gas takes a U-turn in a space 1*c* of the bottom portion 1*a* to flow through the other side in the width direction of the flat tube 1. After that, the flue gas flows out from the outlet pipe 14 of the outlet tank portion 7*b*. As a result, heat is exchanged between the cooling water 10 and the flue gas 9. During the heat exchange, the flat tube 1 extends, caused by the thermal expansion, relative to the casing 5 because the flue gas 9 flows inside the flat tube 1. The thermal expansion is, however, absorbed by the deformation of the elastic support 11. In addition, as illustrated in FIG. 2, the elastic support 11 holds the bottom portion 1*a* of each flat tube 1, thereby absorbing the vibrations and other mechanical disturbances during operation to protect the brazed portion of the flat tube 1.

The above bypass valve 8 may be eliminated. In that case, the connection opening 6*a* of the partition 6 is not required.

Figure 5:
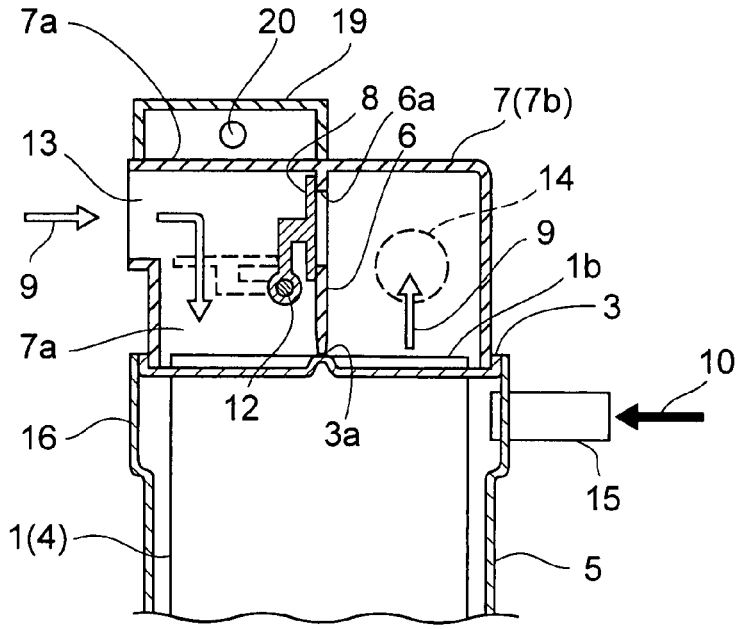
FIG. 5 shows a longitudinal cross sectional view of a principal part of another example of the EGR cooler according to the present invention.

FIG. 5 shows another example of the EGR cooler of the present invention. The only difference from the EGR cooler in FIG. 1 is the shape of the header plate 3. According to the example of FIG. 1, the edge of the partition 6 is inserted into the notched portion 25 of each flat tube 1, and the edge thereof is formed to contact with the header plate 3. To the contrary, the example of FIG. 5 has the protruded strip 3*a* at an intermediate position in the width direction of the header plate 3, and the edge of the protruded strip 3*a* becomes flush with the opening 1*b* of the flat tube 1. The protruded strip 3*a* is brought into contact and fixed together with the edge of the partition 6 using brazing or other means.

With the configuration, the inlet tank portion 7*a* and the outlet tank portion 7*b* are perfectly separated from each other.

Figure 6A:
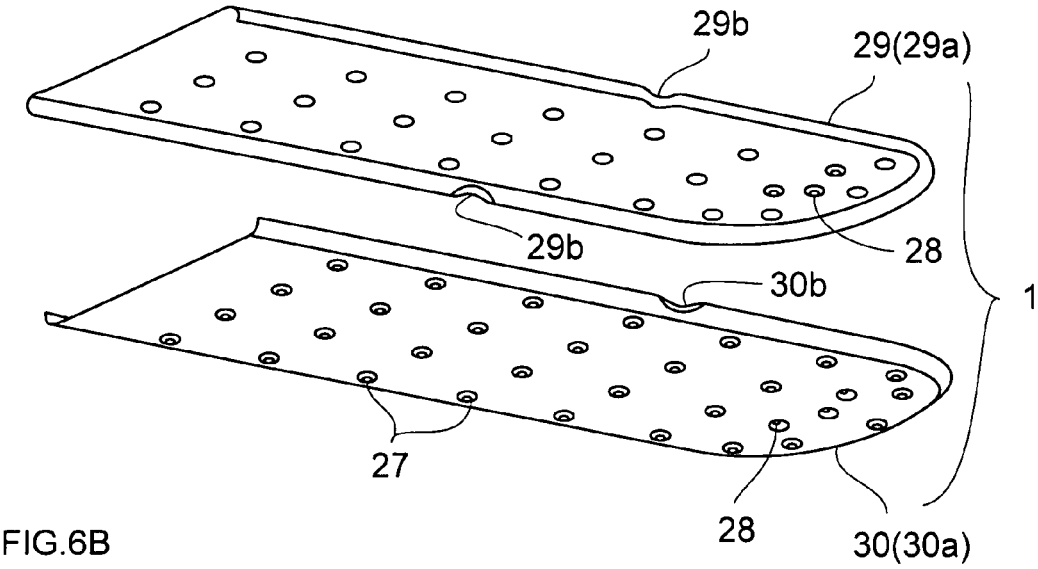
FIG. 6 shows an exploded perspective view and an assembled plan view of another example of the flat tube applied in the EGR cooler.
Figure 6B:
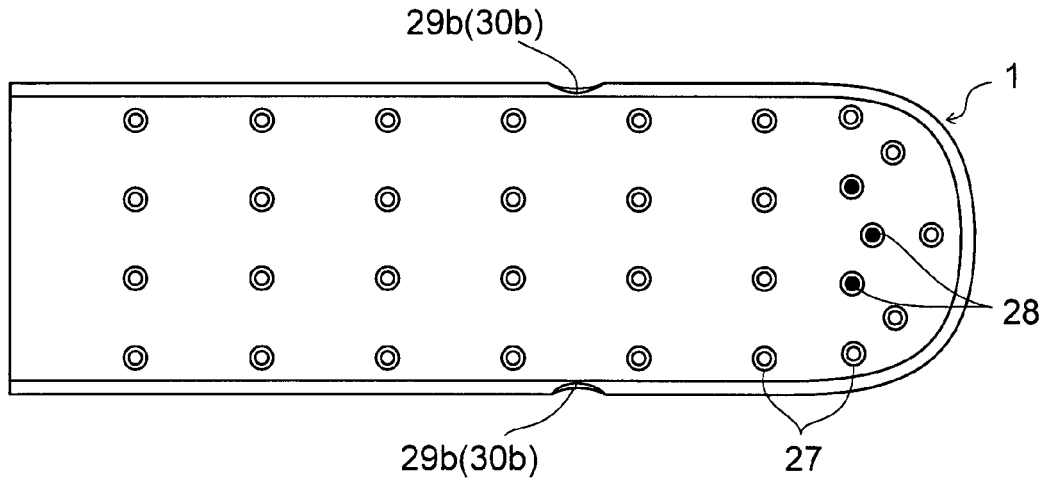

FIG. 6 shows still another example of the flat tube 1 applied in the EGR cooler of the present invention. FIG. 6(A) shows an exploded perspective view of the flat tube, and FIG. 6(B) shows the plan view of the assembled one. The flat tube 1 is formed by press-forming, and has a combination of a pair of plates 29 and 30, having the respective side walls 29*a* and 30*a* erecting at the periphery thereof except at the opening thereof, and has the respective concave portions 29*b* and 30*b*, matching with each other, on the respective side walls 29*a* and 30*a*. The pair of plates 29 and 30 is combined together, and the concave portions 29*b* and 30*b* are fitted each other, thereby preventing from misalignment of the plates in the face direction. Then, in a state that the opening side of the flat tube 1 penetrates through the tube insertion hole of the header plate, the insertion portion and the contact portion of each of the plates 29 and 30 are brazed to fix together. On outer face of the plates 29 and 30, there are formed a large number of dimples 27 as spacers, and at center portion of the flat semicircular portion of the plates 29 and 30, there are formed convex portions 28 at inside of them for reinforcement. Respective convex portions 28 of the pair of plates 29 and 30 contact with each other, and the contact portions are brazed together. In addition, the dimples 27 on a flat tube 1 contact with the dimples 27 on adjacent flat tube 1 at the respective positions thereof.

Figure 7:
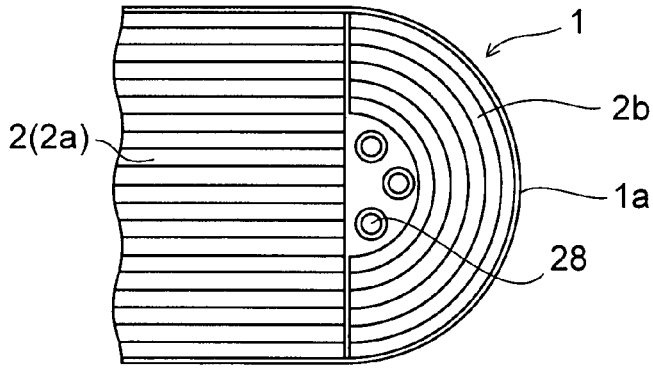
FIG. 7 shows an internal plan view of a further example of the flat tube applied in the EGR cooler.

FIG. 7 shows a further example of the flat tube 1 applied in the EGR cooler of the present invention. At inside the flat tube 1, there are arranged corrugated fins 2 having the respective straight ridgelines 2*a*. At the bottom portion 1*a* in a flat semicircular shape, there are arranged auxiliary fins 2*b*. Each of the fins 2 and 2*b*, and the inside face of the plates 29 and 30 are brazed to fix them together. The auxiliary fins 2*b* are formed so as the ridgeline of each fin to become arc shape. At the center portion of the bottom portion 1*a* in semicircular shape, there are arranged a plurality of convex portions 28, similar to FIG. 6. The auxiliary fins 2*b* are not necessarily limited to the above example, and there may be used offset fins which have corrugated shape having cut-louvers on rise and down faces of each fin. In that case, the total outer circumference of the fin can be formed in semicircular shape.

What is claimed is:

1. An EGR cooler comprising:

a core including a plurality of flat tubes, each one tube of the plurality of tubes having a closed bottom portion at one end, an opening at another end opposite said one end, and a flat face, the plurality of flat tubes being arranged with the respective flat faces being parallel;

a header plate through which said another end of each one of the plurality of flat tubes penetrates, and to which each one of the plurality of flat tubes is fixed;

a casing at an outer circumference of the core, the casing having a first flow medium inlet and a first flow medium outlet, the casing enclosing a portion of the core at least from the bottom portion of each one tube of the plurality of flat tubes to a portion of the plurality of flat tubes fixed to said header plate;

a tank body having a partition between a second flow medium inlet portion and a second flow medium outlet portion, the partition located at an intermediate position in a width direction of said opening of each one of the flat tubes, the tank body also having an open end which is closed by the header plate;

an elastic support located within the casing, receiving at a first end at least some of the bottom portion of each one tube of the plurality of flat tubes, and fitted at a second end to a concave portion of the casing, the concave portion at an intermediate position along a bottom of the casing; and a bracket fixed to the casing at the concave portion, the bracket fixing the elastic support to the casing;

wherein each one tube of the plurality of flat tubes comprises a plurality of corrugated fins extending respectively from said opening to said bottom portion;

wherein a first flow medium flow path is formed through the casing in which a first flow medium introduced into the casing via the first flow medium inlet flows at an outer circumferential surface of each one tube of the plurality of flat tubes to the first flow medium outlet;

wherein a second flow medium flow path is formed in which a flue gas flows from the second flow medium inlet portion through the respective openings of the plurality of flat tubes at one side of said partition, said flue gas flowing toward the respective bottom portions of the plurality of flat tubes, then being redirected at the respective bottom portions to flow through the plurality of flat tubes out respective openings at another side of the partition to the second flow medium outlet portion; and wherein the elastic support is deformable to absorb thermal expansion of the plurality of flat tubes.

2. The EGR cooler of claim 1, wherein said partition has a connection opening which is closed by a bypass valve capable of being arbitrarily closed or opened.

3. The EGR cooler of claim 1, wherein each of said flat tubes penetrating through said header plate has a notched portion at an intermediate position of a tube edge in a width direction, cut to the face of the header plate, wherein an edge of said partition contacts the notched portion.

4. The EGR cooler of claim 1, wherein said header plate has a protruded strip at a position facing an edge of said partition, wherein the protruded strip and an edge of each of said flat tubes are flush with each other, and the edge of said partition contacts the protruded strip.

5. The EGR cooler of claim 1, wherein an outer circumference of said bottom portion of each of said flat tubes is formed in an arc shape, auxiliary fins are arranged at the bottom portion, and the bottom portion and the auxiliary fins are brazed to fix them together.

6. The EGR cooler of claim 1, wherein each one tube of said plurality of tubes comprises a pair of plates fitted together at their periphery except at said one tube's opening.

7. The EGR cooler of claim 1, wherein the casing is closed at said bottom, the casing having a first annular expanded portion of wider diameter toward the bottom and having a second annular expanded portion of wider diameter toward an end opposite the bottom, the first flow medium inlet located at one of the first and second annular expanded portions, the first flow medium outlet located at the other of the first and second annular expanded portions.

* * * * *